US010670291B2

(12) United States Patent
Yoo et al.

(10) Patent No.: US 10,670,291 B2
(45) Date of Patent: Jun. 2, 2020

(54) DAMPER SWITCH

(71) Applicant: MIDOENC Co., Ltd., Paju-si, Gyeonggi-do (KR)

(72) Inventors: Byung Kyu Yoo, Seoul (KR); Joo Hwan Jang, Seoul (KR); Byung Jun Shin, Suwon-si (KR); Dong Bum Kim, Seoul (KR)

(73) Assignee: MIDOENC CO., LTD., Paju-si, Gyeonggi-Do (KR)

( * ) Notice: Subject to any disclaimer, the term of this patent is extended or adjusted under 35 U.S.C. 154(b) by 173 days.

(21) Appl. No.: 15/737,482

(22) PCT Filed: Jun. 17, 2016

(86) PCT No.: PCT/KR2016/006496
§ 371 (c)(1),
(2) Date: Dec. 18, 2017

(87) PCT Pub. No.: WO2016/204582
PCT Pub. Date: Dec. 22, 2016

(65) Prior Publication Data

US 2018/0172307 A1 Jun. 21, 2018

(30) Foreign Application Priority Data

Jun. 18, 2015 (KR) ..... 10-2015-0086859

(51) Int. Cl.
*F24F 11/34* (2018.01)
*A62C 2/16* (2006.01)
(Continued)

(52) U.S. Cl.
CPC ..... *F24F 11/34* (2018.01); *A62C 2/16* (2013.01); *A62C 2/24* (2013.01); *F24F 11/46* (2018.01);
(Continued)

(58) Field of Classification Search
CPC .. F24F 11/34; F24F 11/46; F24F 11/30; F24F 13/06; F24F 13/10; F24F 2013/0608; A62C 2/16; A62C 2/24
See application file for complete search history.

(56) References Cited

U.S. PATENT DOCUMENTS

2005/0287947 A1* 12/2005 Ulicny ..... F24F 13/1426 454/358

FOREIGN PATENT DOCUMENTS

CN 103854417 A 6/2014
EP 1679477 A1 7/2006
(Continued)

*Primary Examiner* — Steven B McAllister
*Assistant Examiner* — Charles R Brawner
(74) *Attorney, Agent, or Firm* — Novick, Kim & Lee, PLLC; Jae Youn Kim

(57) ABSTRACT

Disclosed are a damper switch mounted on a damper having a blade opening/closing structure to open/close blades of the damper, and a damper including the same. The damper switch configured to open/close a plurality of blades of a damper according to the present invention includes a rotating part mounted on a damper shaft of the damper and rotated together with the damper shaft, a driving part configured to provide a power for rotating the rotating part, and a controller configured to measure a load applied to the driving part when the blades are closed, and interrupt an electric power supplied to the driving part when the measured load is not less than a predetermined value.

8 Claims, 7 Drawing Sheets

(51) Int. Cl.

| | |
|---|---|
| ***A62C 2/24*** | (2006.01) |
| ***F24F 13/10*** | (2006.01) |
| ***F24F 11/46*** | (2018.01) |
| ***F24F 13/06*** | (2006.01) |

(52) U.S. Cl.
CPC ..... *F24F 13/06* (2013.01); *F24F 13/10* (2013.01); *F24F 2013/0608* (2013.01)

(56) References Cited

FOREIGN PATENT DOCUMENTS

| | | | | | |
|---|---|---|---|---|---|
| GB | 1375186 | A | | 11/1974 | |
| KR | 20-0375641 | Y1 | | 3/2005 | |
| KR | 20-0423332 | Y1 | | 8/2006 | |
| KR | 10-2007-0013513 | A | | 1/2007 | |
| KR | 10-2009-0071818 | A | | 7/2009 | |
| KR | 20090071818 | A | * | 7/2009 | ..... A62C 2/22 |
| KR | 10-2010-0122989 | A | | 11/2010 | |
| KR | 10-1009856 | B1 | | 1/2011 | |
| KR | 10-1205976 | B1 | | 11/2012 | |
| KR | 101205976 | B1 | * | 11/2012 | ..... F24F 11/0001 |
| KR | 20130110680 | A | * | 10/2013 | ..... A62C 2/16 |
| KR | 20-0473282 | Y1 | | 6/2014 | |

* cited by examiner

DAMPER SWITCH

TECHNICAL FIELD

The present invention relates to a damper switch mounted on a damper such as an air conditioning damper used for air conditioning in a daily life and a smoke exhaust damper for fire fighting in fire situations, to automatically open/close a blade of the damper.

BACKGROUND ART

FIG. 1 is a system diagram schematically illustrating a general smoke removal system.

As illustrated in FIG. 1, a smoke removal equipment system 1 is generally installed inside a building to prevent smoke or toxic gases from spreading to an evacuation area such as an emergency exit and stairs when a fire occurs. At this time, the smoke removal equipment system 1 refers to an equipment system as one of extinguishing activity equipment, which effectively discharges smoke and toxic gases generated when a fire occurs, to remove smoke hindering an extinguishing activity. Such a smoke removal equipment system 1 includes an ejector, a fire damper, an air inlet, and the like in addition to a smoke exhaust blower 3, an air supply blower 4, a smoke exhaust duct 5, an air supply duct 6, a smoke exhaust damper 10, and an air supply damper 20.

In particular, the smoke exhaust damper 10 of the conventional smoke removal equipment system 1 is connected to the smoke exhaust duct 5 serving as an air passage for discharging smoke, is installed in emergency stairs or elevator electric rooms of a high-rise building or an apartment, and plays an important role in initially suppressing a fire or preventing combustion expansion or damage for humans by discharging smoke generated during a fire to the outside by the smoke exhaust blower 3.

When a fire occurs, a blade (wing) of the smoke exhaust damper 10 of a fire area A should be opened to discharge smoke to the outside by the smoke exhaust blower 3. To this end, only the smoke exhaust damper 10 of the fire area A should be opened. In other words, a blade of the smoke exhaust damper 10 installed in a non-fire area B should maintain a completely closed state. That is, this is because when the blade of the smoke exhaust damper 10 in the non-fire area B maintains a completely sealed state, the smoke exhaust blower 3 suctions smoke and toxic gases in the fire area A to smoothly discharge the smoke and the toxic gases to the outside of a building.

FIG. 2 is a schematic view for explaining a structure of a blade of a general smoke exhaust damper.

As illustrated in FIG. 2, in the smoke exhaust damper 10 used for the above purpose, blades 11 are transversely arranged. In more detail, in the smoke exhaust damper 10, both ends of the plurality of blades 11 are formed to be concave such that the blades 11 are engaged (hinged) with each other. Accordingly, when a central damper shaft 13 is rotated by a connection link stand 19 in which a connection hinge 17 is formed, rotary support shafts 15 are rotated together by connection hinges 17 connected to the other blades 11. That is, in the smoke exhaust damper 10, when the central damper shaft 13 is rotated, like a domino phenomenon, the left and right other connection hinges 17 are moved in a chain manner by the connection hinges 17 connected to the central damper shaft 13 on the connection link stand 19, so that the opening/closing of the blades 11 of the smoke exhaust damper 10 may be adjusted.

However, after the damper shaft 13 at the center of the smoke exhaust damper 10 operated in this principle is mounted inside a damper switch 100, and the plurality of blades 11 is fixed in an airtightly closed state, and are installed in the smoke exhaust duct 5, when electric power is initially applied, the blades 11 are rotated by the damper switch 100 mounted on the smoke exhaust damper 10. At this time, while the blades 11 are opened and then closed, the blades 11 are not accurately closed due to a defect of a leakage gap between the blades 11, which is generated due to structural characteristics and uses of the smoke exhaust damper 10, and thus, a smoke removal equipment in a building is not operated well.

Further, as a distance between the central damper shaft 13 and the rotary support shafts 15 of the smoke exhaust damper 10 becomes larger, it is difficult to adjust the plurality of blades 11 connected to the rotary support shafts 15 only through movement of the central damper shaft 13. Therefore, because a mechanical clearance of the smoke exhaust damper 10 itself is generated, the leakage gap of 3 to 5% is formed basically.

Meanwhile, the above-described problem occurs not only in a smoke exhaust damper or a smoke removal damper used for fire fighting in fire situations but also in various kinds of dampers having a blade opening/closing structure, including an air conditioning damper used for air conditioning in a daily life.

The related art document related thereto corresponds to Korean Utility Model No. 20-0423332 (Name of invention: damper for fire prevention and airflow control of ventilation duct of building, registration date: Jul. 31, 2006).

DISCLOSURE

Technical Problem

An aspect of the present invention is to provide a damper switch mounted on a damper having a blade opening/closing structure to fully shield gaps between blades of the damper to maintain airtightness, and a damper including the same.

Technical Solution

The aspect is achieved by a damper switch for opening/closing a plurality of blades of a damper, and a damper including the same, in which the damper switch includes a rotating part mounted on a damper shaft of the damper and rotated together with the damper shaft, a driving part configured to provide a power for rotating the rotating part, and a controller configured to measure a load applied to the driving part when the blades are closed, and interrupt an electric power supplied to the driving part when the measured load is not less than a predetermined value.

Preferably, the controller maintains consistently the electric power supplied to the driving part when the load applied to the driving part is smaller than the predetermined value if the blades are closed.

Preferably, the load applied to the driving part indicates the magnitude of a current consumed in the driving part, and the predetermined value is set as a specific ratio for the magnitude of a maximum allowable current of the driving part.

Preferably, the rotating part includes a rotary shaft having an insertion hole into which the damper shaft is inserted, and a rotating plate coupled to a circumference of the rotary shaft.

Preferably, the damper switch further includes a sensor unit having a pair of optical sensors located on opposite sides with the rotary shaft interposed therebetween. More preferably, through-holes are formed in the rotary shaft in a direction in which the through-holes cross the insertion hole, the sensor unit generates an electric signal when the through-holes are arranged in parallel to the pair of optical sensors, and the controller interrupts an electric power supplied to the driving part when receiving the electric signal from the sensor unit.

Preferably, when the damper shaft is inserted into the rotary shaft, and the through-holes are thus blocked, even when the through-holes are arranged in parallel to the pair of optical sensors, the electric signal is not generated.

Preferably, the damper switch further includes a limit switch located on a rotational trajectory of the rotating plate, and configured to generate an electric signal when coming into contact with one end of the rotating plate if the blades are opened, and the controller interrupts the electric power supplied to the driving part when receiving the electric signal from the limit switch if the blades are opened.

Preferably, the damper switch further includes a clamp configured to fix the damper shaft to the rotary shaft, and the clamp includes a clamping jig fastened to one end of the rotary shaft, and a clamping ring mounted on the clamping jig to fix the rotary shaft to the clamping jig.

Preferably, the clamp further includes a snap ring configured to fix the clamping jig to the rotary shaft such that the clamping jig is not separated from the rotary shaft, a jig groove inserted in a longitudinal direction of the rotary shaft and a snap ring groove inserted in a center direction of the rotary shaft are formed at one end of the rotary shaft, the clamping jig includes an annular part surrounding a circumference of the rotary shaft, and a jig protrusion protruding inward from the annular part and seated on the jig groove, and the snap ring is inserted into the snap ring groove in a state in which the clamping jig is seated on the one end of the rotary shaft.

Advantageous Effects

According to the present invention, as a damper shaft is rotated until a load applied to a driving part arrives at a predetermined value when blades are closed, a leakage gas area is minimized, so that airtightness is improved.

Further, according to the present invention, as a driving current applied to the driving part is set to be interrupted when a maximum value of the load applied to the driving part is not less than a predetermined value if the blades are closed, malfunction of a motor resulting from an overload is prevented, and an unnecessary electric power is not consumed, so that energy may be saved.

Further, as a rotation angle of the blades of the damper is restrained by an optical sensor in a state in which a damper shaft is not mounted, a driving state or malfunction of a damper switch may be previously identified before the damper switch according to the present invention is mounted on the damper, so that reliability of a product may be improved.

BEST MODE

Figure 1:
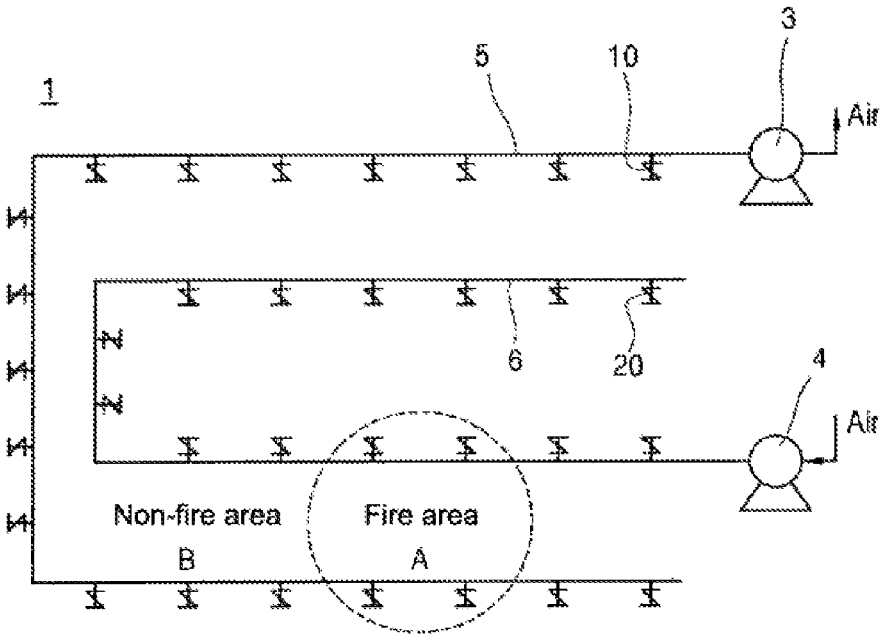
FIG. 1 PRIOR ART
FIG. 1 is a system diagram schematically illustrating a general smoke removal system.
Figure 2:
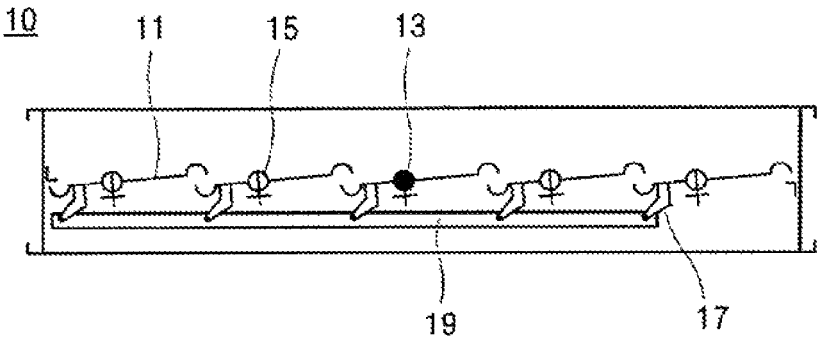
FIG. 2 PRIOR ART
FIG. 2 is a schematic view for explaining a structure of a blade of a general smoke exhaust damper.

Advantages and/or features of the present invention and methods for achieving the same will be clearly described with reference to embodiments described later in detail together with the accompanying drawings. However, the present invention is not limited to the embodiments disclosed below but may be implemented in various forms. The present embodiments merely make disclosure of the present invention complete, and are provided to completely notify those skilled in the art to which the present invention pertains of the scope of the invention, and the present invention is defined by the scope of the appended claims. The same components are designated by the same reference numerals throughout the specification.

Hereinafter, a damper switch according to the present invention, which is applied to a smoke exhaust damper used for firing fighting in fire situations, will be described as an embodiment. However, it is apparent that the damper switch according to the present invention is not applied to only the smoke exhaust damper or a smoke removal damper, and may be applied to various kinds of dampers having a blade opening/closing structure, including an air conditioning damper used for air conditioning in a daily life.

Figure 3:
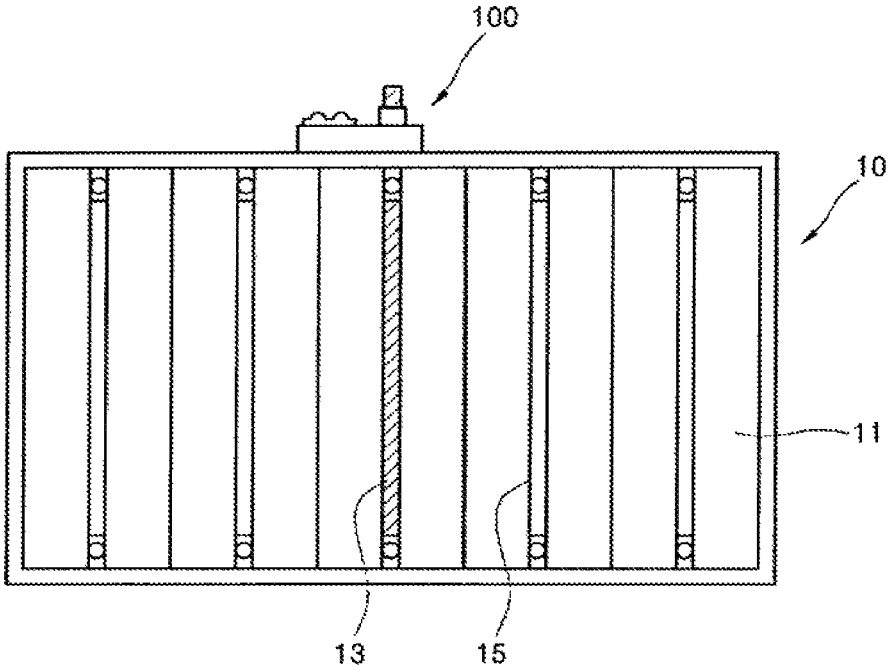
FIGS. 3 and 4 are a front view and a rear view illustrating a state in which a damper switch according to an embodiment of the present invention is installed in the smoke exhaust damper.
Figure 4:
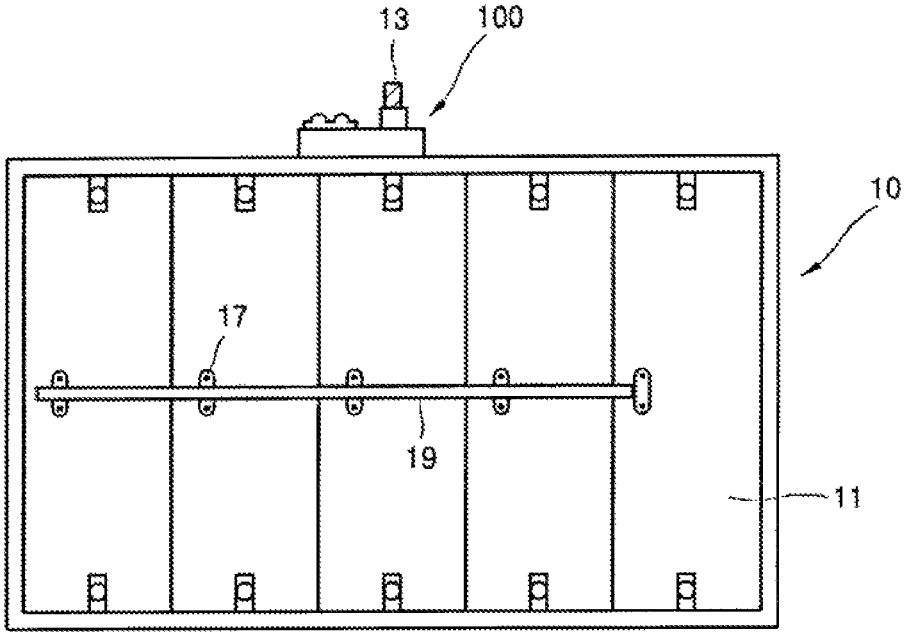

FIGS. 3 and 4 are a front view and a rear view illustrating a state in which a damper switch according to an embodiment of the present invention is installed in the smoke exhaust damper.

As illustrated in FIGS. 3 and 4, a damper switch 100 according to the present invention is provided on one side of a smoke exhaust damper 10 to open/close a plurality of blades 11, and is connected to a damper shaft 13 located at the center of the smoke exhaust damper 10 to rotate the damper shaft 13 so as to adjust an opening/closing degree of the blades 11.

Further, in description of an operation principle of the blades 11 when the damper switch 100 according to the present invention is mounted on the smoke exhaust damper 10, the damper switch 100 according to the present invention rotates the central damper shaft 13 to move connection hinges 17 connected to the damper shaft 13. At this time, because the connection hinges 17 installed on a connection link stand are connected to each other, even when only one of the connection hinges 17 connected to the damper shaft 13 is moved, the other connection hinges 17 connected to rotary support shafts 15 are successively moved, so that the plurality of blades 11 may be opened or closed.

The damper switch 100 according to the present invention is installed on one side of the smoke exhaust damper 10 to rotate the damper shaft 13, so that gaps between the blades 11 may be completely shielded, and smoke generated due to a fire may be prevented from spreading to a non-fire area.

Further, the damper switch 100 according to the present invention may be applied to the smoke exhaust damper 10 in consideration of a pressure generated from a smoke moving force (chimney effect, buoyancy, expansion, wind, and the like) generated when a fire occurs.

In this way, the blades 11 of the smoke exhaust damper 10 may be opened/closed by the damper switch 100 according to the present invention, and a configuration of the damper switch 100 configured to completely shield the blades 11 in the non-fire area B such that only smoke in the fire area A may be discharged will be described below in detail.

Figure 5:
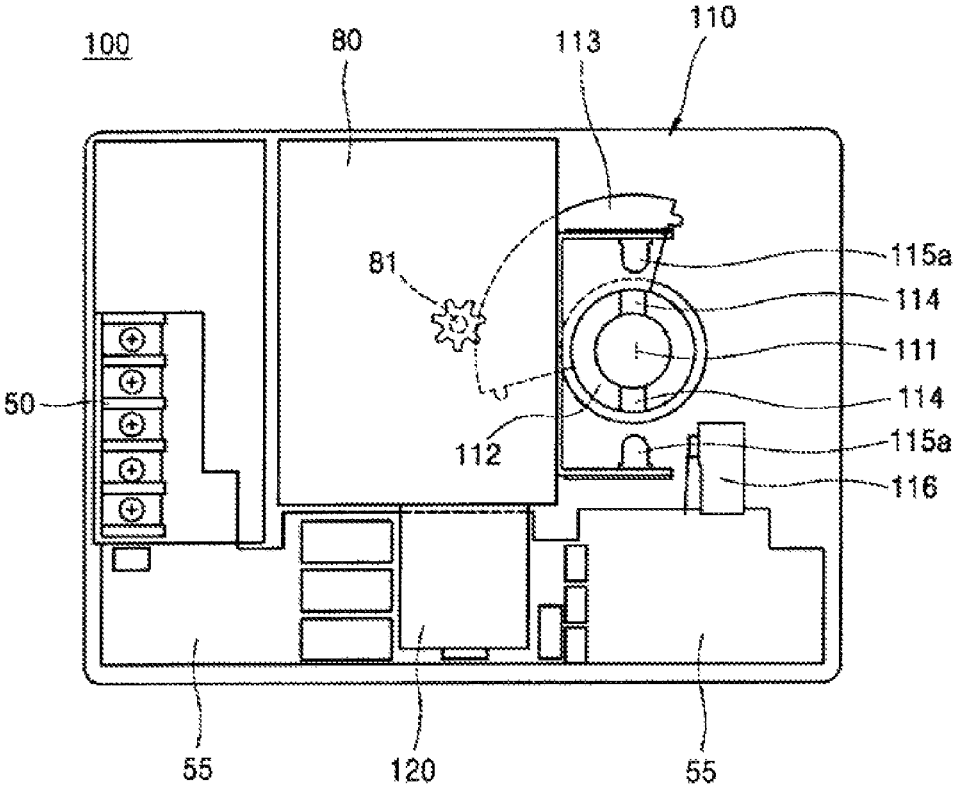
FIGS. 5 and 6 are a diagram and a block diagram for explaining a configuration of the damper switch according to the embodiment of the present invention.
Figure 6:
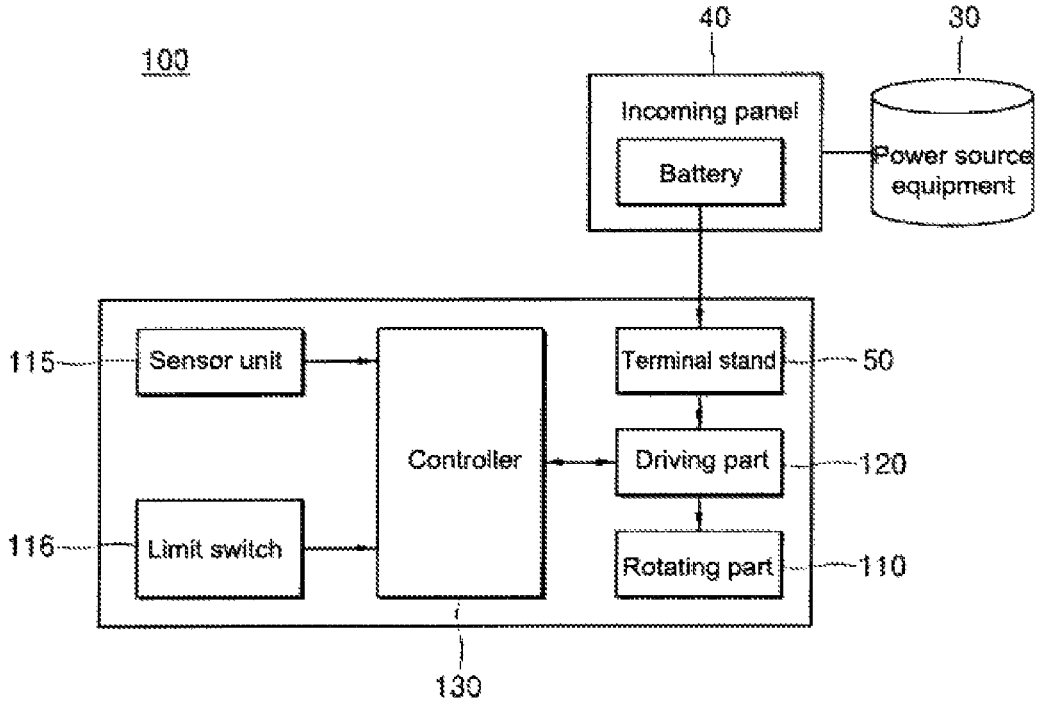

FIGS. 5 and 6 are a diagram and a block diagram for explaining a configuration of the damper switch according to the embodiment of the present invention.

As illustrated in FIG. 5, the damper switch 100 according to the present invention may include a rotating part 110 mounted on the damper shaft 13 of the smoke exhaust damper 10 and rotated together with the damper shaft 13, a driving part 120 configured to provide a power for rotating the rotating part 110, and a controller 130 configured to measure a load applied to the driving part 120 when the blades 11 are closed, and interrupt an electric power supplied to the driving part 120 when the measured load is not less than a predetermined value.

The rotating part 110 is configured to receive a rotational power from the driving part 120 to rotate the damper shaft 13, in order to open or close the blades 11.

Further, the rotating part 110 may include a rotary shaft 112 having an insertion hole 111 into which the damper shaft 13 is inserted, and a rotating plate 113 coupled to a circumference of the rotary shaft 112.

In detail, because the damper shaft located at the center of the smoke exhaust damper 10 is inserted into the insertion hole 111 of the rotary shaft 112, the rotary shaft 112 and the damper shaft 13 are integrally coupled to each other, so that the damper shaft 13 may be rotated by rotation of the rotary shaft 112. That is, the rotary shaft 112 may be provided in a hollow shape into which the damper shaft 13 may be inserted.

At this time, when the rotary shaft 112 of the rotating part 110 is rotated in a clockwise direction, the blades 11 are closed, and when the rotary shaft 112 is rotated in a counterclockwise direction, the blades 11 are opened.

The rotating plate 113 may be provided at a portion of the rotary shaft 112 in a circumferential direction, and may be rotated to rotate the rotary shaft 112. That is, the rotating plate 113 may receive a power of the driving part 120 to be rotated, and the rotary shaft 112 may be rotated through the rotation of the rotating plate 113 to open/close the blades 11.

At this time, the damper switch 100 according to the present invention may further include a deceleration gear box 80 configured to transfer the power of the driving part 120 to the rotating part 110. The deceleration gear box 80 may receive the power of the driving part 120 to rotate a gear shaft 81, the gear shaft 81 may be engaged with the rotating plate 113, and the rotating plate 113 may be rotated through operation of the gear shaft 81.

A distal end of the rotating plate 113 is formed in a sawtooth, and is engaged with a sawtooth of the gear shaft 81 of the deceleration gear box 80, and as the gear shaft 81 is rotated by the power of the driving part 120, the rotating plate 113 may be rotated in a clockwise direction or a counterclockwise direction.

At this time, the gear shaft 81 of the deceleration gear box 80 may be provided in a five-stage reduction gear to reduce an electric power required for operating the gear shaft 81. For reference, the deceleration gear box 80 is a flat panel, in which various gears and the gear shaft 81 are combined and arranged to rotate the damper shaft 13 of the blade 11.

As described above, the driving part 120 may provide a power such that the rotating part 110 may be rotated, and may be implemented by a motor. As a result, the driving part 120 allows the damper shaft 13 to be rotated.

In detail, the driving part 120 may rotate the gear shaft 81 of the deceleration gear box 80 to rotate the rotating plate 113 engaged with the gear shaft 81. Next, when the rotating plate 113 provided in the rotary shaft 112 is rotated, the damper shaft 13 is inserted into the insertion hole 111 of the rotary shaft 112, so that the blades 11 may be opened/closed.

The controller 130 may measure a torque of the motor installed in the driving part 120, detect a driving load according to the measured torque, and apply a driving current to the gear shaft 81 to rotate the rotating plate 113.

As described above, the controller 130 may measure the load applied to the driving part 120 when the blades 11 are closed, and may interrupt the electric power supplied to the driving part 120 when the measured load is not less than a predetermined value.

That is, when the blades 11 are closed, if the load applied to the driving part 120 is smaller than a predetermined maximum allowable current, the electric power supplied to the driving part 120 may be consistently maintained.

At this time, the load applied to the driving part 120 refers to the magnitude of a current consumed by the driving part 120, and the predetermined value may be set as a specific ratio of the magnitude of the maximum allowable current of the driving part 120.

That is, the controller 130 may preset the magnitude of the current according to the magnitude of the maximum allowable current applied according to the driving load of the driving part 120. For reference, the controller 130 may perform a control to apply a driving current of about 80% of a limit value within an allowable range of the driving current.

Thus, when the driving load is not less than a predetermined value, the driving current applied to the driving part 120 is instantly interrupted, or when a value of the load is not reduced even if a predetermined period of time elapses, the driving current is interrupted, so that an unnecessary electric power is not consumed.

Further, when the driving load is smaller than a predetermined value, a driving current applied to the driving part 120 is consistently maintained to a predetermined value, so that the blades 11 may be completely shielded. In such a case, even when foreign substances are caught in the blades 11 or a leakage gap is generated due to a mechanical clearance, the controller 130 maintains the driving current applied to the driving part 120 to the predetermined value, so that a gap between the blades 11 may be reduced, and airtightness may be improved.

In the damper switch 100 according to the present invention, as the driving current is applied according to the predetermined value by the controller 130, according to the above-described configuration, power consumption may be reduced, and at the same time, an amount of leakage gas may be reduced.

Meanwhile, as illustrated in FIG. 6, in order to provide the electric power supplied to the driving part 120 of the damper switch 100 according to the present invention, a terminal stand 50 inside a printed circuit board (PCB) substrate 55 on which the driving part 120 is installed may be wired to a battery of an incoming panel 40 installed in each floor or the underground of a building. At this time, electric power may be supplied to the incoming panel 40 by a power source equipment 30 installed in the outside. For reference, the power source equipment is a generic name of a power receiving and transforming equipment, a self-power generation equipment for preliminary emergency security, a copper storage battery equipment, and the like.

Meanwhile, the damper switch 100 according to the present invention may further include a limit switch 116 located on a rotational trajectory of the rotating plate 113 to generate an electric signal if being in contact with one end of the rotating plate 113 when the blades 11 are opened (are rotated in a counterclockwise direction).

As illustrated in FIG. 6, the limit switch 116, which is configured to stop an opening operation of the blades 11, may generate an electric signal while being in contact with the one end of the rotating plate 113. Such a signal is transmitted to the controller 130 to interrupt the power of the driving part 120.

When the blades 11 are opened, the rotary shaft 112 is rotated in a counterclockwise direction, so that the one end of the rotating plate 113 comes into contact with the limit switch 116. Accordingly, the blades 11 may be in a maximally opened state.

Meanwhile, the damper switch 100 according to the present invention may further include a sensor unit 115 including a pair of optical sensors 115*a* located on opposite sides with the rotary shaft 112 interposed therebetween, to determine whether the one end or the other end of the rotating plate 113 in a longitudinal direction is rotated by a predetermined angle. That is, before the damper shaft 13 is mounted on the insertion hole 111, the pair of optical sensors 115*a* may communicate with each other, to check whether the damper switch 100 according to the present invention is normally operated or not.

The sensor unit 115 may include the pair of optical sensors 115*a*, and the pair of optical sensors 115*a* may be arranged to face each other with the rotary shaft 112 of the rotating part 110 interposed therebetween. That is, the pair of optical sensors 115*a* may be provided on a side of a lower casing 70 of the smoke exhaust damper 10 in which the rotary shaft 112 is provided. For reference, although it is preferable that the sensor unit 115 includes the optical sensors 115*a*, the present invention is not limited thereto, and the sensor unit 115 may be implemented by various widely-known sensors which may detect a movement of an object.

Here, through-holes 114 may be formed in the rotary shaft 112 such that the pair of optical sensors 115*a* may communicate with each other.

That is, the through-holes 114 may be formed in the rotary shaft 112 to cross the insertion hole 111, and when the blades 11 are closed, the sensor unit 115 may generate an electric signal when the through-holes 114 are arranged in parallel to the pair of optical sensors 115*a*. Accordingly, as illustrated in FIG. 6, the sensor unit 115 may transmit an electric signal to the controller 130 to interrupt the electric power supplied to the driving part 120.

In other words, the sensor unit 115 may be provided so as not to generate an electric signal even when the through-holes 114 are arranged in parallel to the pair of optical sensors 115*a* if the damper shaft 13 is inserted into the rotary shaft 112, and thus, the through-holes 114 are blocked.

Thus, as the pair of optical sensors 115*a* provided to be operated only in a state in which the damper shaft 13 is not mounted on the rotary shaft 112 may communicate with each other only when the optical sensors 115*a* are aligned with the through-holes 114 of the rotary shaft 112 on a straight line, an operation state of the rotating plate 113 may be identified, and failure of the rotating plate 113 may be identified, so that reliability of the device itself may be improved.

Figure 7:
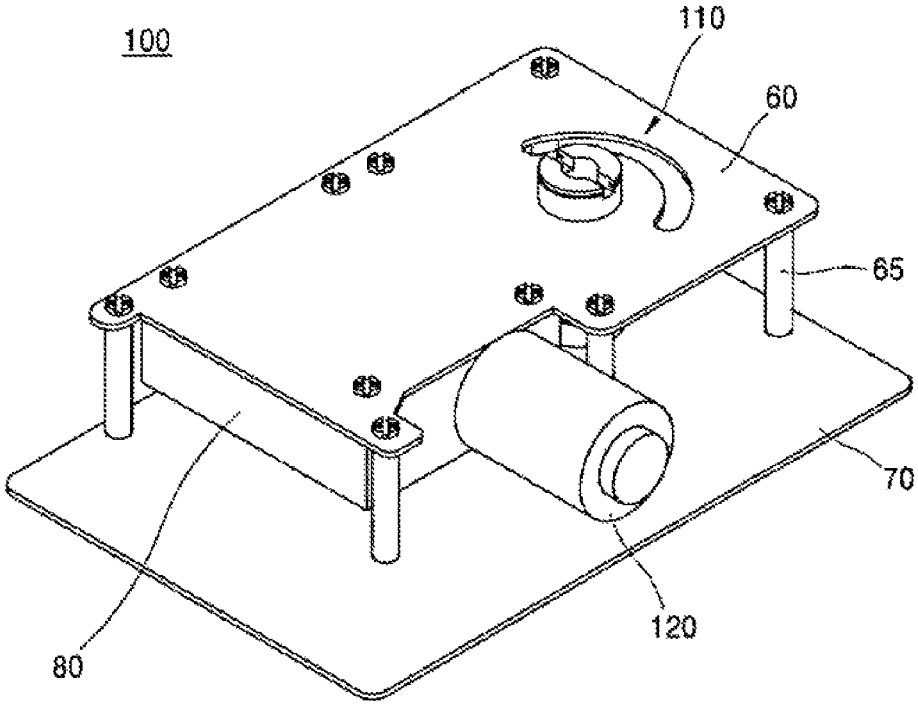
FIG. 7 is a perspective view schematically illustrating the damper switch according to the embodiment of the present invention.

FIG. 7 is a perspective view schematically illustrating the damper switch according to the embodiment of the present invention.

As illustrated in FIG. 7, the damper switch 100 according to the present invention may further include an upper casing 60 and a lower casing 70 for supporting or protecting components therein. At this time, a support 65 may be further provided between the upper casing 60 and the lower casing 70 to connect the upper casing 60 and the lower casing 70 to each other. At this time, although it is preferable that the upper casing 60 or the lower casing 70 and the support 65 are coupled to each other through a bolt, the present invention is not limited thereto.

Although the upper casing 60 has a curved hole, and a handle or a lever may be further formed in the hole such that a fixed position or an operating position of the rotating part 110 may be manually changed by a worker when a fire occurs, the shape and the position of the hole is not limited.

Although the terminal stand 50, the PCB substrate 55, the limit switch 116, the deceleration gear box 80, the pair of optical sensors 115*a*, and the driving part 120 are provided in the lower casing 70, positions thereof are not limited within the scopes of roles of the components.

Figure 8:
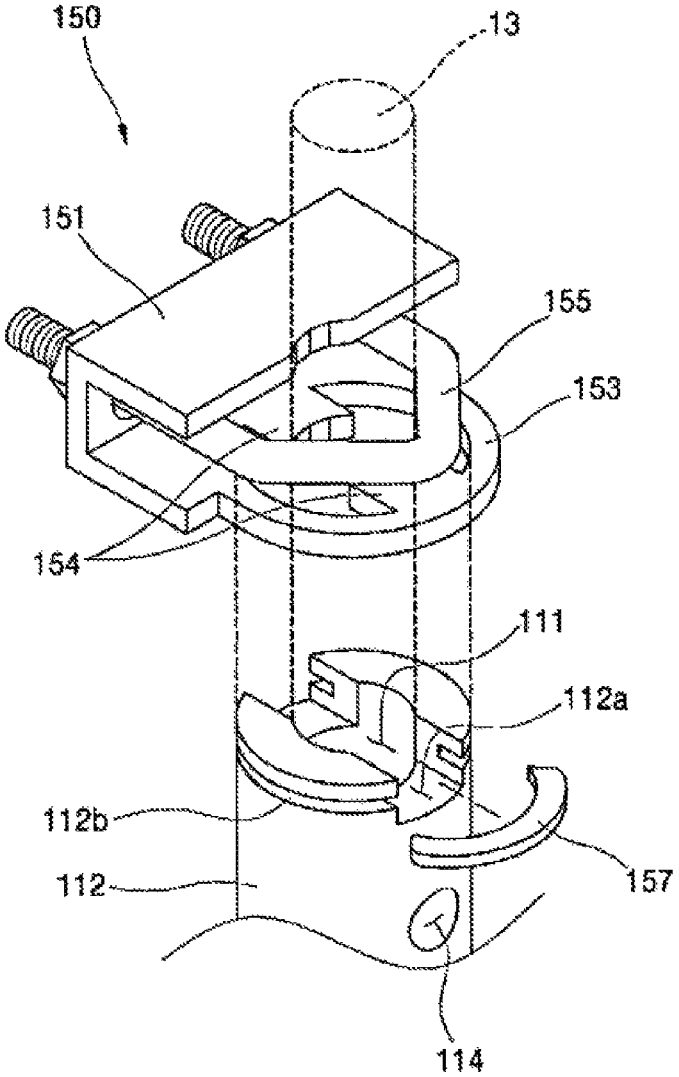
FIG. 8 is a perspective view for explaining a clamp configured to fix a shaft of the damper to a rotary shaft of the damper switch while the damper switch is mounted on the damper according to the embodiment of the present invention.

FIG. 8 is a perspective view for explaining a clamp configured to fix a shaft of the damper to a rotary shaft of the damper switch while the damper switch is mounted on the damper according to the embodiment of the present invention.

As illustrated in FIG. 8, the damper switch 100 according to the present invention may further include a clamp 150 configured to fix the damper shaft 13 to the rotary shaft 112.

The clamp 150 may be provided to fix the damper shaft 13 to the rotary shaft 112 such that the damper shaft 13 is not separated from the rotary shaft 112 when the damper shaft 13 is inserted into the insertion hole 111 of the rotary shaft 112.

At this time, the clamp 150 may include a clamping jig 151 fastened to one end of the rotary shaft 112 and a clamping ring 155 mounted on the clamping jig 151 to fix the rotary shaft 112 to the clamping jig 151.

The clamping jig 151 is fastened to the one end of the rotary shaft 112 such that the clamp 150 is not separated from the rotary shaft 112, and the clamping ring 155 may fix the damper shaft 13 inserted into the rotary shaft 112. At this time, although it is preferable that coupling between the clamping jig 151 and the clamping ring 155 is bolt coupling, the present invention is not limited thereto.

Further, the clamp 150 may further include a snap ring 157 configured to fix the clamping jig 151 to the rotary shaft 112 such that the clamping jig 151 is not separated from the rotary shaft 112.

At this time, a jig groove 112*a* inserted in a longitudinal direction of the rotary shaft 112 and a snap ring groove 112*b* inserted in a center direction of the rotary shaft 112 may be formed at the one end of the rotary shaft 112.

Further, the clamping jig may include an annular part 153 surrounding a circumference of the rotary shaft 112, and a jig protrusion 154 protruding inward from the annular part 153 and seated on the jig groove 112*a*.

The snap ring 157 may be inserted into the snap ring groove 112*b* in a state in which the clamping jig 151 is seated on the one end of the rotary shaft 112.

That is, the clamp 150 fixes the damper shaft 13 inserted into the rotary shaft 112, to make an opening/closing operation of the blades 11 smooth.

As above, although the present invention has been described with reference to the limited embodiments and the accompanying drawings, the present invention is not limited to the above embodiments, and various modifications and changes may be derived from the above description by those skilled in the art to which the present invention pertains. Thus, the spirit of the present invention should be understood by the appended claims, and all equivalent changes thereof belong to the scope of the technical spirit of the present invention.

INDUSTRIAL AVAILABILITY

The present invention may be used in various kinds of dampers having a blade opening/closing structure, such as an air conditioning damper used for air conditioning in a daily life and a smoke exhaust damper used for firing fighting in fire situations.

The invention claimed is:

1. A damper switch for opening/closing a plurality of blades of a damper, the damper switch comprising:

a rotating part mounted on a damper shaft of the damper and rotated together with the damper shaft;

a driving part including a motor and configured to provide a power for rotating the rotating part; and a controller configured to measure a load applied to the driving part when the blades are closed, and interrupt an electric power supplied to the driving part when the measured load is not less than a predetermined value, wherein the rotating part comprises:

a rotary shaft having an insertion hole into which the damper shaft is inserted; and a rotating plate coupled to a circumference of the rotary shaft, and wherein the damper switch further comprises a pair of optical sensors located on opposite sides with the rotary shaft interposed therebetween, wherein through-holes are disposed in the rotary shaft in a direction in which the through-holes cross the insertion hole, wherein the pair of optical sensors generates an electric signal when the through-holes are arranged in parallel to the pair of optical sensors, and wherein the controller interrupts the electric power supplied to the driving part when receiving the electric signal from the pair of optical sensors.

2. The damper switch of claim 1, wherein the controller maintains the electric power supplied to the driving part when the load applied to the driving part is smaller than the predetermined value.

3. The damper switch of claim 1, wherein the load applied to the driving part indicates a magnitude of a current consumed in the driving part, and the predetermined value is set as a specific ratio for a magnitude of a maximum allowable current of the driving part.

4. The damper switch of claim 1, wherein when the damper shaft is inserted into the rotary shaft, and the through-holes are thus blocked, even when the through-holes are arranged in parallel to the pair of optical sensors, the electric signal is not generated.

5. The damper switch of claim 1, further comprising a limit switch located on a rotational trajectory of the rotating plate, and configured to generate an electric signal when coming into contact with one end of the rotating plate if the blades are opened, wherein the controller interrupts the electric power supplied to the driving part when receiving the electric signal from the limit switch if the blades are opened.

6. The damper switch of claim 1, further comprising a clamp configured to fix the damper shaft to the rotary shaft, wherein the clamp comprises:

a clamping jig fastened to one end of the rotary shaft.

7. The damper switch of claim 6, wherein the clamp further comprises a snap ring configured to fix the clamping jig to the rotary shaft such that the clamping jig is not separated from the rotary shaft, wherein the rotary shaft includes a jig groove and a snap ring groove, both of the jig groove and the snap ring groove being disposed at one end of the rotary shaft, wherein the clamping jig comprises an annular part surrounding a circumference of the rotary shaft, and a jig protrusion protruding inward from the annular part and seated on the jig groove, and wherein the snap ring is inserted into the snap ring groove in a state in which the clamping jig is seated on the one end of the rotary shaft.

8. A damper comprising the damper switch of claim 1.

* * * * *